US008857020B2

(12) United States Patent
Birkmeyer et al.

(10) Patent No.: US 8,857,020 B2
(45) Date of Patent: Oct. 14, 2014

(54) ACTUATORS AND METHODS OF MAKING THE SAME

(75) Inventors: Jeffrey Birkmeyer, San Jose, CA (US); Darren T. Imai, Los Gatos, CA (US); Andreas Bibl, Los Altos, CA (US); Zhenfang Chen, Sunnyvale, CA (US)

(73) Assignee: FUJIFILM Corporation, Tokyo (JP)

( * ) Notice: Subject to any disclaimer, the term of this patent is extended or adjusted under 35 U.S.C. 154(b) by 832 days.

(21) Appl. No.: 12/992,246

(22) PCT Filed: May 21, 2009

(86) PCT No.: PCT/US2009/044858
§ 371 (c)(1),
(2), (4) Date: Feb. 3, 2011

(87) PCT Pub. No.: WO2009/143354
PCT Pub. Date: Nov. 26, 2009

(65) Prior Publication Data

US 2011/0115341 A1 May 19, 2011

Related U.S. Application Data

(60) Provisional application No. 61/055,768, filed on May 23, 2008.

(51) Int. Cl.
*B41J 2/16* (2006.01)

(52) U.S. Cl.
CPC ..... *B41J 2/161* (2013.01); *B41J 2/1623* (2013.01); *B41J 2/1631* (2013.01); *B41J 2/1628* (2013.01); *B41J 2/1645* (2013.01); *B41J 2/1646* (2013.01); *B41J 2/1643* (2013.01); *B41J 2/1629* (2013.01)
USPC ..... 29/25.35; 29/890.1; 29/847; 430/313; 347/70; 347/71

(58) Field of Classification Search
CPC ..... B41J 2/161; B41J 2/1623; B41J 2/1626; B41J 2/1631; B41J 2/1643; B41J 2/1645; B41J 2/1646; B41J 2/1268; B41J 2/1629; H05K 3/0023
USPC ..... 29/25.35, 890.1, 846, 847; 430/313, 430/320, 394; 347/68, 70, 71
See application file for complete search history.

(56) References Cited

U.S. PATENT DOCUMENTS 5,945,254 A * 8/1999 Chien et al. ..... 430/313 X
6,252,290 B1 6/2001 Quek et al.

(Continued)

FOREIGN PATENT DOCUMENTS

JP 57028223 A * 2/1982 ..... 29/25.35
JP 11-207957 8/1999
WO 2009/143354 11/2009

OTHER PUBLICATIONS

International Search Report and Written Opinion dated Jul. 14, 2009 issued in international application No. PCT/US2009/044858, 8 pgs.

*Primary Examiner* — A. Dexter Tugbang
(74) *Attorney, Agent, or Firm* — Fish & Richardson P.C.

(57) ABSTRACT

A method of forming an actuator includes depositing a photoimageable material to form a first photoimageable layer on a piezoelectric layer; patterning the first photoimageable layer to form an aperture; and disposing a first conductive layer on the first photoimageable layer. An actuator device formed by this method includes the photoimageable material. The first conductive layer partially overlies the first photoimageable layer such that a first portion of the first conductive layer contacts the first photoimageable layer and a second portion of the first conductive layer electrically contacts the piezoelectric layer in the aperture.

12 Claims, 5 Drawing Sheets

(56) References Cited

U.S. PATENT DOCUMENTS

| | | | | |
|---|---|---|---|---|
| 6,609,785 | B2 * | 8/2003 | Hashizume et al. | 347/70 |
| 6,921,159 | B2 * | 7/2005 | Sakamoto et al. | 347/70 |
| 7,344,228 | B2 | 3/2008 | Bibl et al. | |
| 2003/0087199 | A1 * | 5/2003 | Kim et al. | 430/320 |
| 2004/0021005 | A1 | 2/2004 | Stout et al. | |
| 2005/0275694 | A1 | 12/2005 | Murata et al. | |
| 2006/0023032 | A1 | 2/2006 | Bibl et al. | |
| 2007/0182287 | A1 | 8/2007 | Lukacs et al. | |

* cited by examiner

ACTUATORS AND METHODS OF MAKING THE SAME

CROSS-REFERENCE TO RELATED APPLICATIONS

This application is the national stage of International Application Number PCT/US2009/044858, filed on May 21, 2009, which is based on and claims the benefit of the filing date of U.S. Provisional Application No. 61/055,768, filed on May 23, 2008, both of which as filed are incorporated herein by reference in their entireties.

BACKGROUND

The following description relates to using a photoimageable material as an intermediate layer.

Photoimageable materials provide a convenient means for forming patterned layers, such as in a semiconductor device. An exemplary process for patterning photoimageable materials is to expose the materials to radiation, such as light, and developing to remove unwanted portions material and to form a desired pattern. Some types of photoimageable materials can also function as adhesive to bond components or layers. Their adhesive nature allows joining objects with a wide range of planarity or roughness. Photoimageable materials can also be used for fabrication of structures.

SUMMARY

In one aspect, a method for forming an actuator includes depositing a photoimageable material to form a first photoimageable layer on a piezoelectric layer, patterning the first photoimageable layer to form an aperture, and disposing a first conductive layer on the first photoimageable layer. The first conductive layer partially overlies the first photoimageable layer such that a first portion of the first conductive layer contacts the first photoimageable layer and a second portion of the first conductive layer electrically contacts the piezoelectric layer in the aperture.

In another aspect, a method for forming an actuator includes depositing a photoimageable material to form a first photoimageable layer on a piezoelectric layer, patterning the first photoimageable layer to form a plurality of apertures, and disposing a first conductive layer on the first photoimageable layer. The first conductive layer partially overlies the first photoimageable layer such that a first portion of the first conductive layer contacts the first photoimageable layer and a plurality of second portions of the first conductive layer electrically contact the piezoelectric layer in the plurality of apertures. The first portion of the first conductive layer is patterned to form a plurality of conductive traces on the first photoimageable layer connected to the plurality of second portions of the first conductive layer.

Implementations can include one or more of the following features. The first photoimageable layer may be an insulating layer between the first conductive layer and the piezoelectric layer. The photoimageable material may include SU-8. In some implementations, depositing the photoimageable material may include spraying the photoimageable material onto the piezoelectric layer and exposing the photoimageable material to ultraviolet light. In other implementations, depositing the photoimageable material may include spin coating the photoimageable material onto the piezoelectric layer and exposing the photoimageable material to ultraviolet light. Depositing the photoimageable material onto the piezoelectric layer may be performed before the piezoelectric layer is patterned.

The method can include patterning the first conductive layer to form a plurality of conductive traces on the first photoimageable layer, and depositing the photoimageable material in at least one space between two adjacent conductive traces disposed on the first photoimageable layer. The photoimageable material between the adjacent conductive traces can contact at least a portion of the first photoimageable layer. The method can include depositing the photoimageable material to form a second photoimageable layer on a plurality of conductive traces formed from the first conductive layer.

The method can also include disposing the piezoelectric layer adjacent to a first substrate having a pumping chamber formed adjacent to an upper surface of the first substrate and a nozzle, and bonding the first substrate to a second substrate using the photoimageable material. The pumping chamber may be in fluidic communication with the nozzle. The piezoelectric layer may be positioned between the first substrate and the second substrate. The method can further include coating at least one surface of the second substrate with the photoimageable material. In some implementations, disposing the piezoelectric layer may include disposing the piezoelectric layer on a membrane over the pumping chamber. The method can further include disposing a second conductive layer adjacent to the first substrate such that the piezoelectric layer is positioned between the first conductive layer and the second conductive layer.

In another aspect, an actuable device includes a piezoelectric layer, a first photoimageable layer disposed on the piezoelectric layer, a first conductive layer, and a plurality of conductive traces on the first photoimageable layer and formed from the first conductive layer. In the actuable device, the first photoimageable layer includes a photoimageable material and has an aperture formed within the photoimageable layer. A first portion of the first conductive layer contacts the first photoimageable layer and a second portion of the first conductive layer electrically contacts the piezoelectric layer in the aperture.

In another aspect, an actuatable device includes a piezoelectric layer, a first photoimageable layer disposed on the piezoelectric layer, a first conductive layer, and a plurality of conductive traces on the first photoimageable layer formed from the first conductive layer. The first photoimageable layer includes a photoimageable material and has a plurality of apertures formed therein, a first portion of the first conductive layer contacts the first photoimageable layer and a plurality of second portions of the first conductive layer electrically contacts the piezoelectric layer in the plurality of apertures, and the plurality of conductive traces are connected to the plurality of second portions of the first conductive layer.

Implementations can include one or more of the following features. The first photoimageable layer may be an insulating layer between the first conductive layer and the piezoelectric layer. The photoimageable material may include SU-8. The photoimageable material may be in at least one space between two adjacent conductive traces such that the photoimageable material contacts at least a portion of the first photoimageable layer. A second photoimageable layer may be on the plurality of conductive traces, and the second photoimageable layer may include the photoimageable material.

The device can further include a first substrate adjacent to the piezoelectric layer, and a second substrate bonded to the first substrate using the photoimageable material. The first substrate may have a pumping chamber adjacent to an upper surface of the first substrate and a nozzle, and the pumping chamber may be in fluidic communication with the nozzle. The piezoelectric layer may be positioned between the first substrate and the second substrate. In some embodiments, at least one surface of the second substrate may be coated with the photoimageable material.

The device can include a second conductive layer adjacent to the first substrate such that the piezoelectric layer is positioned between the first conductive layer and the second conductive layer. In some embodiments, a portion of the piezoelectric layer may be on a membrane over the pumping chamber, and a second conductive layer may be on an opposite side of the piezoelectric layer from the first conductive layer. The first conductive layer and the second conductive layer may directly contact the portion of the piezoelectric layer on the membrane.

Implementations of the devices and methods described herein may include one or more of the following advantages. Materials currently used for the intermediate layer to reduce power needed to drive an actuator can create manufacturing obstacles as they may require a complicated process for forming the layer. If the intermediate layer is formed of an oxide, achieving a desired oxide layer pattern can require depositing and patterning a photoresist mask on the oxide layer, exposing the photoresist, etching the oxide, and stripping the photoresist. Photoimageable materials or photoresists, e.g., SU-8—an epoxy-based negative photoresist, do not entail the additional steps of applying an additional layer, patterning and etching because the photoimageable materials can be directly removed from the regions that need power to function. Photoimageable materials can also be used as an adhesive to bond various components or substrates in a device. The photoimageable materials can form a planar surface over a non-planar surface. Layers of photoimageable material can protect components in a device, such as conductive traces, and prevent the components from directly being exposed to air or corrosive material attack, for example.

Details of one or more implementations are set forth in the accompanying drawings and the description below. Other features and advantages may be apparent from the description and drawings, and from the claims.

DRAWING DESCRIPTIONS

These and other aspects will now be described in detail with reference to the following drawings.

Like reference symbols in the various drawings indicate like elements.

DETAILED DESCRIPTION

In forming structures with actuators, one design goal can be to reduce the power required to drive the actuator. Exemplary structures with actuators include microelectromechanical (MEMS) devices, such as, fluidic pumps, printhead structures, microphones, accelerometers, sensors or other such structures. The goal to reduce the power requirement of an actuator may be achieved by depositing a dielectric, e.g., non-conductive or insulating, intermediate layer between a piezoelectric layer and a conductive layer adjacent to portions of the actuator that need not be actuated. This way, the regions of the two layers (the piezoelectric and the conductive layer) that are in electrical contact are reduced, resulting in lower voltage that is needed to be applied to drive the actuator. Specific applications or devices for this technique are drop-on-demand ink jet print heads, as described below.

Figure 1:
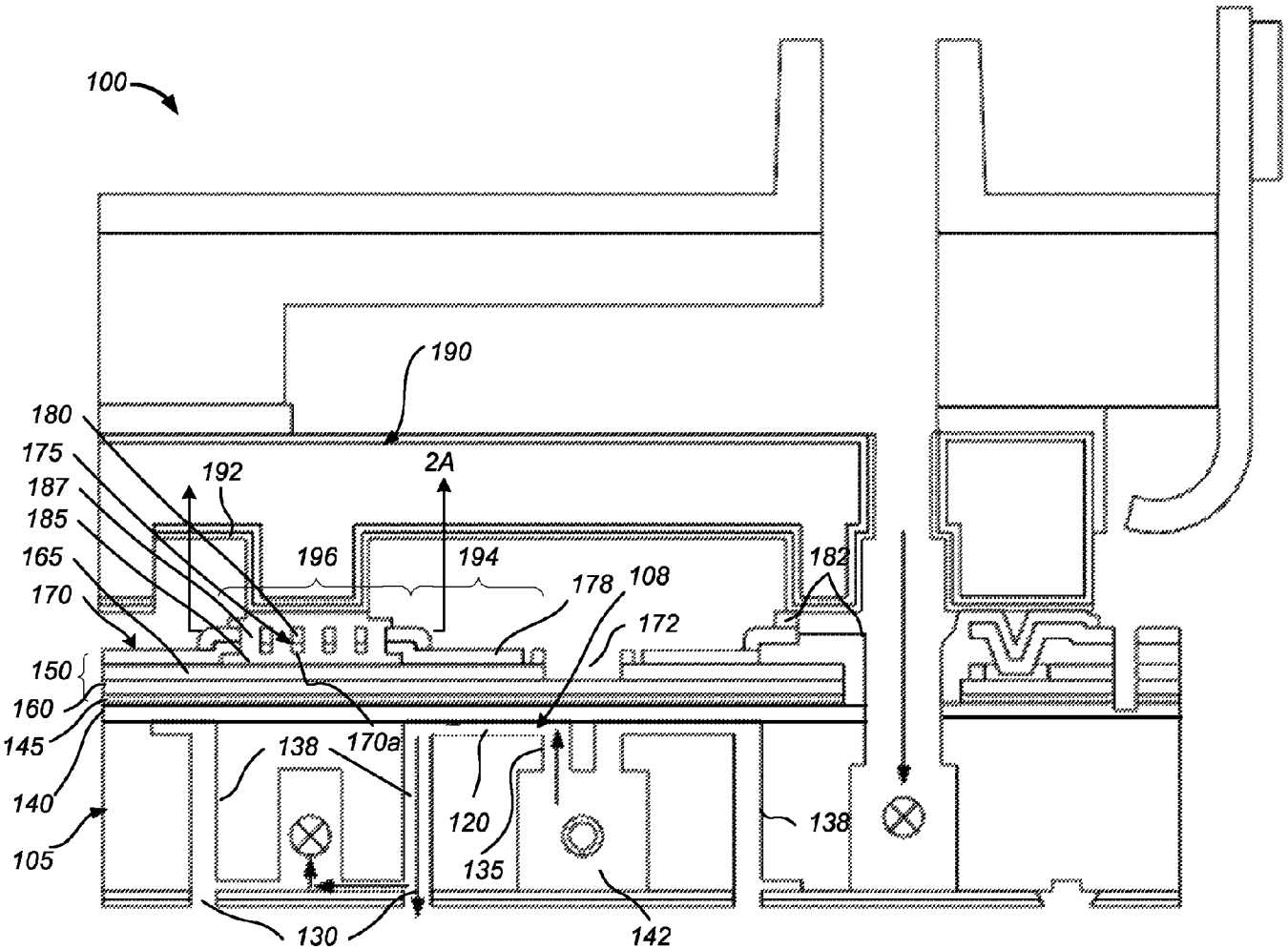
FIG. 1 is a cross-sectional view of a multi-layered actuator in a drop-on-demand ink jet printhead.

FIG. 1 is a cross-sectional view of a multi-layered actuator in a drop-on-demand ink jet printhead. A printhead device 100 has a number of jetting structures, each of which is associated with an actuator 150 and a fluid path 108. The actuator 150 is supported on a substrate 105 (e.g., a silicon substrate), within which fluid paths are formed. The substrate 105 can include a membrane 140, such as a layer of silicon, which seals one side of a pumping chamber 120 in the fluid path 108. The membrane 140 can be relatively thin, such as less than 25 μm, for example about 12 μm. A single fluid path 108 includes an ink feed 142, an ascender 135, a pumping chamber 120, a descender 138 and a nozzle 130. When the actuator 150 is activated, the activation causes the membrane 140 to deflect into the pumping chamber 120, forcing fluid through the fluid path 108 and out the nozzle 130.

The actuator 150 includes a lower conductive layer 160, a piezoelectric layer 165, and an upper conductive layer 170. The piezoelectric layer 165 can be between about 1 and 25 microns thick, e.g., about 8 to 18 microns thick. In one embodiment, the piezoelectric layer 165 is metalized with a metal that forms the lower conductive layer 160. The metalized piezoelectric layer 165 can be bonded onto the membrane 140, for example, using an adhesive material such as benzocyclobutene (BCB) or a eutectic bond. Alternatively, the piezoelectric layer 165 can be formed directly on the lower conductive layer 160, such as by physical vapor deposition (PVD), sol gel application, bonding ceramic green sheets or another suitable deposition process. A photoimageable material such as SU-8 can be used as an adhesive 182 for bonding the piezoelectric layer 165 the substrate 105 to an interposer 190, for example. Alternatively, the adhesive 182 can be silicone or epoxy, such as BCB.

The upper and lower conductive layers 160 and 170 can be about 2 microns in thickness or less, such as 0.5 microns, respectively. The conductive layers are formed of a conductive material, such as a metal or a conductive oxide. The conductive material that forms the upper and lower conductive layer 160, 170, can be deposited by sputtering. Exemplary materials for the conductive layers include copper, gold, tungsten, tin, indium-tin-oxide (ITO), titanium, platinum, nickel, nickel chromium alloy or a combination of two or more of these metals.

The lower conductive layer 160 can be formed of one or more layers. In some embodiments, the lower conductive layer 160 includes four layers, in order from bottom to top: a titanium tungsten alloy layer, a gold layer, a nichrome layer and another titanium tungsten alloy layer. Similarly, the upper conductive layer 170 can be formed of one or more layers. In some embodiments, the upper conductive layer 170 includes a titanium tungsten alloy layer and a gold layer. The upper conductive layer 170 overlies at least the portion of the piezoelectric layer 165 over the pumping chamber 120 to provide an upper electrode 178, e.g., a drive electrode.

Conductive traces 175 can provide electrical connection to upper electrodes 178 over the pumping chamber 120. In some embodiments, the conductive traces 175 are formed from a lower conductive portion 170*a*, which can be a patterned portion of the upper conductive layer 170, and an upper conductive portion 180 disposed on the lower conductive portion 170*a*. The lower conductive portion 170*a* can include a titanium tungsten alloy layer and a gold layer. The upper conductive portion 180 can include a gold layer. In some embodiments, the upper conductive portion 180 does not extend to cover the upper electrode 178 or the pumping chamber 120. This can reduce the stiffness of the actuator 150 so that a lower drive voltage is required to actuate the active region 194. In some embodiments, the upper conductive portion 180 is deposited only upon the lower conductive portion 170*a* of the conductive traces 175. This can reduce the electrical resistance of the conductive traces 175. Signals can be generated or transmitted by a flexible circuit or integrated circuit to the conductive traces 175, which cause select portions of the upper conductive layer 170 to be biased. The upper conductive layer 170 and the lower conductive layer 160 are not in electrical communication with one another, but are able to create a bias across the piezoelectric layer 165.

In some embodiments, a separation aperture 172 is formed to electrically separate neighboring actuators such that crosstalk between the two actuators can be reduced. In addition, the separation aperture 172 can reduce the actuator size, thereby decreasing power needed for the actuator. The aperture 172 can be cut, diced, sawed, or etched into the piezoelectric layer 165 and can extend into the piezoelectric layer 165 as well as the lower conductive layer 160. Alternatively, the piezoelectric layer 165 can be formed with the separation therein. That is, the individual piezoelectric regions can be formed where each region corresponds to a single actuatable region, such as the pumping chamber 120 of a microfluidic device. The separation aperture 172 can be filled with insulating material such as SU-8 to enhance isolation between adjacent actuators.

As shown in FIG. 1, an insulating layer 185 is formed on the piezoelectric layer 165, for example, by spraying or spin-coating a photoimageable material onto the piezoelectric layer 165. If the photoimageable material is a negative type resist, such as SU8, the photoimageable material can be directly exposed to light, such as ultraviolet light, for removing the non-exposed portions from the actuator's active regions 194. If a positive type resist is used, the portions exposed to light remain soluble and can be removed.

The actuator 150 is over and is able to actuate the pumping chamber 120 and includes the upper and lower conductive layers 170 and 160 and piezoelectric material 165 without any insulator material in between. Active regions 194 include at least the portions of the actuator 150 adjacent to the pumping chamber 120 such that those portions can be deformed or bent to force ink out of the pumping chamber 120.

Inactive regions 196 of the piezoelectric layer 165 are regions that include insulating material 185 between conductive material 160 and 170 and the piezoelectric layer 165 or that do not have any conductive material adjacent to the piezoelectric layer 165. In contrast to active regions 194, inactive regions 196 need not be activated for compressing a pumping chamber 180, such as for the purpose of causing ink to be ejected from the nozzle 130. Inactive regions 196 can be areas not adjacent to the pumping chamber 120. As a result, a bias need not be applied across the inactive regions 196 of the piezoelectric layer.

In some embodiments, the insulating layer 185 is deposited on the inactive regions 196 such that it is sandwiched between the piezoelectric layer 165 and the conductive traces 175. This way, the insulating layer 185 acts as a resistive or capacitive impedance between the upper and lower conductive layers 160 and 170 or between the lower conductive layer 160 and the conductive traces 175, thereby reducing the voltage applied across the portions of the piezoelectric layer 165 adjacent to the insulating layer 185.

In some embodiments, the insulating layer 185 does not end in exact alignment with the boundaries of any parts of the printhead 100. In other embodiments, the insulting layer 185 can be restricted to locations over some parts of the printhead 100, such as in regions that do not overlie the pumping chamber 120. By way of illustration, the insulating layer 185 can be formed above the portions of the substrate 105 between the edges of descenders 138, i.e., the areas that do not overlie the pumping chamber 120.

Figure 2A:
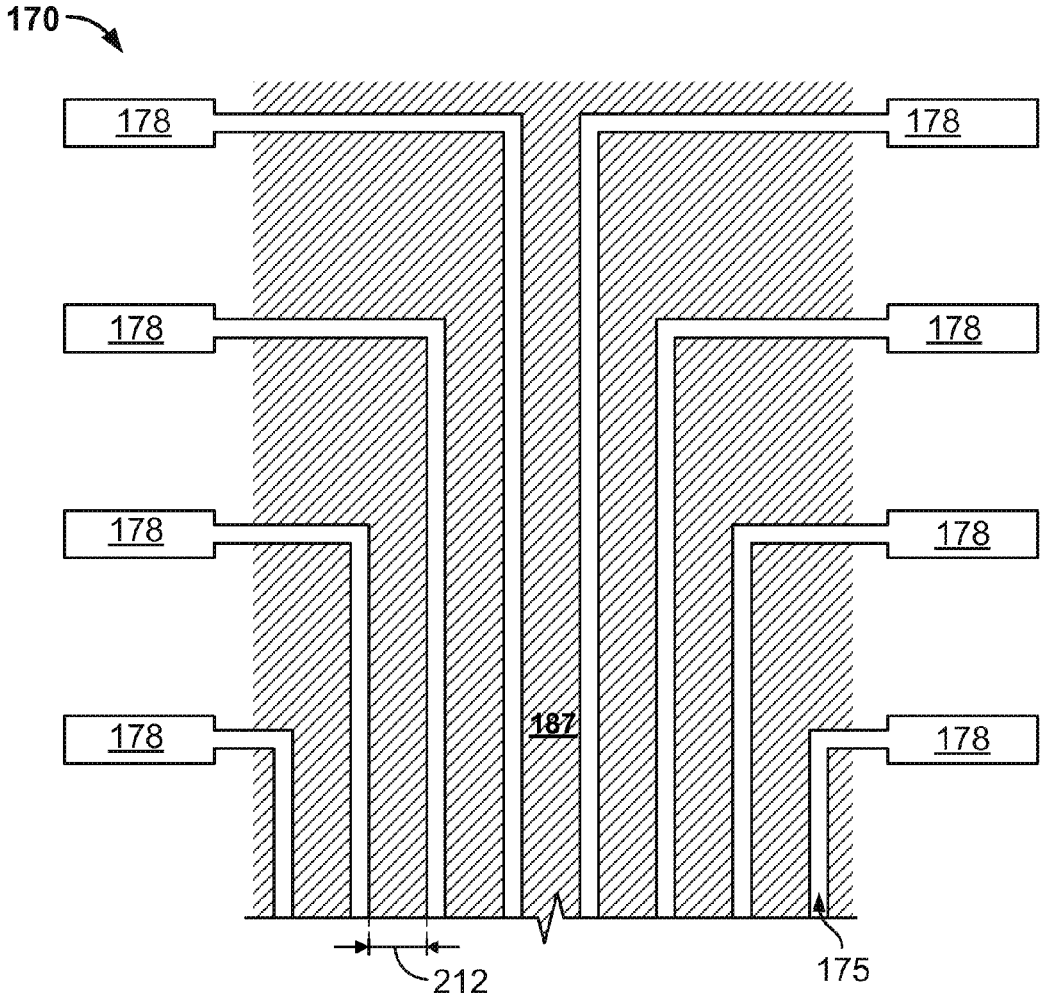
FIGS. 2A and 2B are schematic illustrations of a top view of conductive traces, and a cross-sectional view of the conductive traces with a photoimageable layer thereon, respectively.

FIG. 2A is a schematic illustration of a top view of exemplary conductive traces 175 with a photoimageable material filled in between adjacent conductive traces 175. The conductive traces 175 can be distributed, either substantially evenly, or not evenly, across the insulating layer 185 (shown in FIG. 2B). The conductive traces 175 can be parallel to one another, with each electrically connected to an actuator 150 adjacent to a corresponding pumping chamber 120. As shown in FIG. 2A, two rows of pumping chambers can be formed with the conductive traces 175 between the two rows. The conductive traces 175 can be parallel to one another and branch off in opposite directions to connect to their corresponding upper electrodes 178 over the pumping chambers. A photoimageable material 187, such as SU-8 adhesive, is applied within the spacing 212 between two adjacent conductive traces 175. Due to the adhesive nature of SU-8, the conductive traces 175 are fastened in place because of bonding of the conductive traces 175 to the SU-8.

Figure 2B:
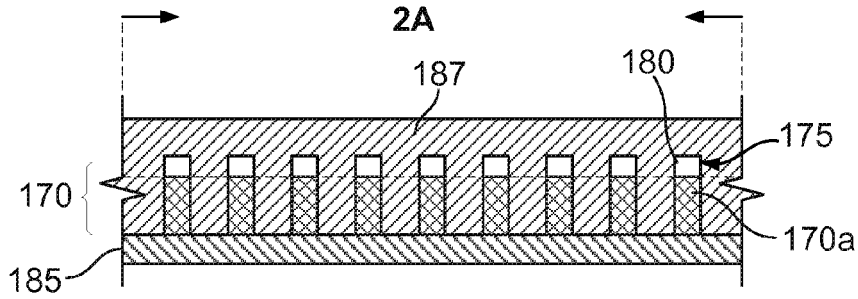

FIG. 2B is a schematic illustration of a cross-sectional view of the conductive traces 175 with a layer of photoimageable material covering thereon. In addition to filling the spacing 212 between the conductive traces 175, the photoimageable material 187 can be applied on top of the conductive traces 175 to protect the traces from exposure to air or corrosive material attack, such as ink. In some embodiments, the photoimageable material 187 within the spacing 212 and on top of the conductive traces 175 forms a planar surface over the conductive traces 175 and thus provides more surface area for bonding to another component, e.g., the interposer substrate 190. The photoimageable material can further extend into recesses between the conductive traces 175 and contact the insulating layer 185 or in apertures in the upper conductive layer 170.

The upper conductive layer 170 can be electrically connected to an integrated circuit through conductive traces 175, such as by bonding the conductive layers to a flexible circuit (not shown), e.g., by soldering the flexible circuit to the conductive traces 175 with a metal or by using a conductive adhesive, such as an anisotropic conductive film. The flexible circuit, or other suitable circuit for delivering signals to the traces 175, is attached in a region free from insulating material.

As shown in FIG. 1, the interposer 190 can be bonded to the substrate 105 using the photoimageable material that covers on top of the conductive traces 175. In addition, the interposer 190 can be coated with the photoimageable material on at least the surfaces 192 near the substrate 105. The photoimageable material, such as SU-8, can also be used as adhesive to bond various components in the printhead device 100. Adhesive bonding can offer potential advantages for interconnecting various components in the printhead device 100 or other MEMS devices. By way of illustration, adhesive bonding can adapt to rougher surfaces of particles or structures while providing sufficient bonding strength in comparison with some other type of bonding. Moreover, the adhesive bonding process is relatively simple and can be carried out at low temperature, such as 100° C., thus reducing the difficulty and cost of bonding. Blanket exposure of SU-8 to ultraviolet light, for example, followed by a hardening process, can serve to sufficiently crosslink and solidify the SU-8 adhesive.

Figure 3:
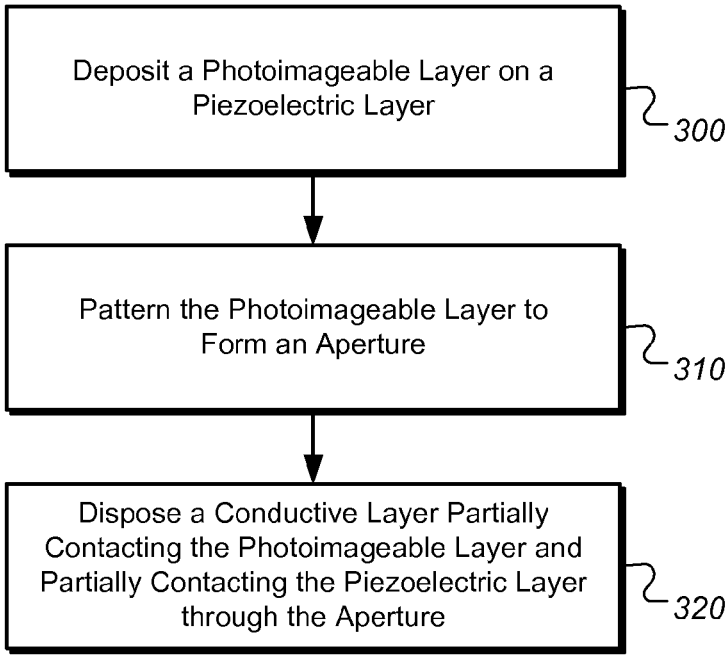
FIG. 3 is a flow chart of an exemplary process for depositing an insulating layer formed of a photoimageable material on a piezoelectric layer of an actuator.

FIG. 3 is a flow chart of an exemplary process for depositing an insulating layer formed of a photoimageable material on a piezoelectric layer of an actuator. A photoimageable layer is deposited on a piezoelectric layer (step 300). In some embodiments, the photoimageable layer serves as an insulting layer between the piezoelectric layer and the conductive layer. The photoimageable material can include SU-8, which can be sprayed or spin-coated onto the piezoelectric layer.

The photoimageable layer is patterned to form an aperture generally overlying the pumping chamber (step 310). The aperture can later receive the conductive layer. The photoimageable layer can be applied only on limited portions of the piezoelectric layer, e.g., inactive regions that are not to be actuated for purpose of imposing pressure on the pumping chamber. Alternatively, the photoimageable layer can be applied on the whole surface of the piezoelectric layer, and then be patterned with additional portions removed to form an aperture or multiple apertures in active regions. In some embodiments where the SU-8, e.g., SU-8 from MicroChem Corp., Newton, Mass., is used as the photoimageable layer, the patterning and developing process includes exposing the SU-8 layer to ultraviolet light and developing the SU-8 in PGMEA (Propylene Glycol Methyl Ether Acetate). In some embodiments, this process can include various baking sessions. For instance, one session can be soft baking the SU-8 at 65° C. for 2 minutes followed by a cooling down period. A subsequent session can be hard baking the SU-8 at around 200° C. for 10 hours. The process can allow for sufficient cross-linking and solidifying reactions within SU-8 to complete patterning.

Prior to depositing the photoimageable material, the piezoelectric layer can be etched to form features, for example, piezoelectric islands over each pumping chamber. The piezoelectric layer can be etched as described in application no. 61/055,431, which is incorporated herein by reference. Rather than etching the piezoelectric layer prior to depositing the photoimageable material, the photoimageable material can be deposited before etching the piezoelectric layer. The photoimageable material is deposited and then patterned to expose areas of the piezoelectric layer. The exposed areas can then be dry-etched to form piezoelectric islands.

When applying the photoimageable material, such as SU-8, prior to etching the piezoelectric layer, a uniform, continuous layer of the photoimageable material can be deposited (e.g., spin-coated or spray-coated) on a flat surface of the piezoelectric layer. On the other hand, with an etched piezoelectric surface, the topography of the piezoelectric layer can cause the photoimageable material to be applied non-uniformly, especially if the photoimageable material is spin-coated. The non-uniform photoimageable layer can cause subsequent layers (e.g., conductive traces) deposited on top of the photoimageable layer to be also uneven. Alternatively, the photoimageable material can be spray-coated onto an etched piezoelectric layer to achieve a relatively uniform layer.

In some embodiments, a patterning process of the SU-8 can include baking a substrate with a piezoelectric layer in a vacuum, dehydrated chamber; depositing (e.g., spin-coating or spray-coating) the SU-8 on the piezoelectric layer; soft baking the SU-8 at about 65° C. for 2 minutes; exposing the SU-8 to ultraviolet light; post-exposure baking SU-8 at 90° C. for 2 minutes; developing the SU-8 in PGMEA; and hard baking the SU-8 at about 200° C. for 10 hours to thoroughly cross-link the SU-8.

A conductive layer is deposited with a part of the conductive layer contacting the photoimageable layer and a different part of the conductive layer electrically contacting the piezoelectric layer through the aperture by sputtering (step 320). The part of the conductive layer in electrical contact with the piezoelectric layer applies a voltage bias across the piezoelectric layer when a signal is transmitted to the conductive layer. Biasing the conductive layers on either side of the piezoelectric layer causes the piezoelectric material to bend or deform, thereby actuating the pumping chamber. In contrast, the part of the conductive layer in contact with the photoimageable layer does not apply a bias voltage (or applies a lower voltage) across the corresponding regions of the piezoelectric layer and does not actuate those regions. The lack of actuation is due to the resistive impedance caused by the photoimageable layer.

In some embodiments, the conductive layer has multiple portions that are in electrical contact with the piezoelectric layer over pumping chambers, respectively. By way of illustration, the photoimageable layer can consist of several non-continuous sections, with an aperture or opening separating adjacent sections. The upper conductive layer, for example, can be arranged to contact the piezoelectric layer in each aperture, thereby being able to actuate the corresponding portions of the piezoelectric layer.

In some embodiments, another conductive layer is disposed adjacent to the piezoelectric layer such that the piezoelectric layer is sandwiched between two conductive layers. The second conductive layer can be formed on the piezoelectric layer directly, or formed onto a substrate or membrane on which the piezoelectric layer is formed prior to application of the piezoelectric layer. The two conductive layers can receive different voltage signals, resulting in a voltage bias across the piezoelectric layer, causing the piezoelectric layer to bend or deform. In contrast, a lower bias is created between the corresponding regions of the two conductive layers that are separated and isolated from one another with an insulating layer in between.

Figure 4:
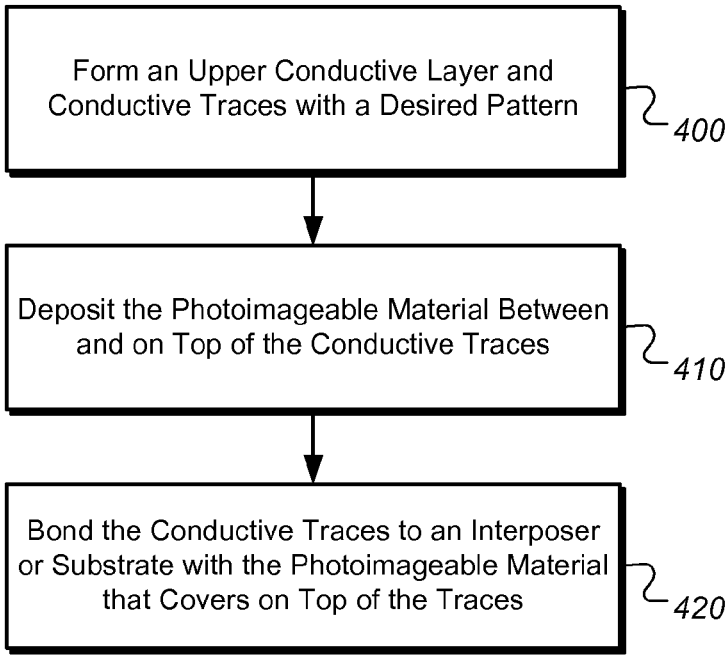
FIG. 4 is a flow chart of an exemplary process for forming conductive traces with a photoimageable material filled in spacing between adjacent conductive traces.

FIG. 4 is a flow chart of an exemplary process for forming a conductive layer with a photoimageable material (e.g., SU-8) filled in spacing between adjacent conductive traces. An upper conductive layer and conductive traces are formed with a desired pattern (step 400). In step 400, an electroplating mask is formed on the upper conductive layer with the pattern of conductive traces. Next, upper conductive portions of conductive traces are formed on the upper conductive layers with the pattern of the conductive traces by electroplating. Then, lower conductive portions of the conductive traces and the upper conductive layer on top of the pumping chambers are formed with the desired pattern by etching. In some embodiments, if the photoimageable material, e.g., SU-8, is applied first, uncured portions of the photoimageable material can be used to lift off any conductive material in areas where the traces are not to be located.

The photoimageable material is deposited between and on top of the conductive traces (step 410). For example, the SU-8 is sprayed or spin-coated between and over the top of the conductive traces. In some embodiments, the SU-8 is applied from top of the conductive traces and naturally covers the traces as well as fills in the spacing between neighboring traces. The SU-8 can further extend into recesses or apertures in the conductive layer and contact a lower or an intermediate insulating layer, for example. If the SU-8 is applied first in step 400, a further layer of SU-8 can be deposited on top of the conductive traces.

Figure 5:
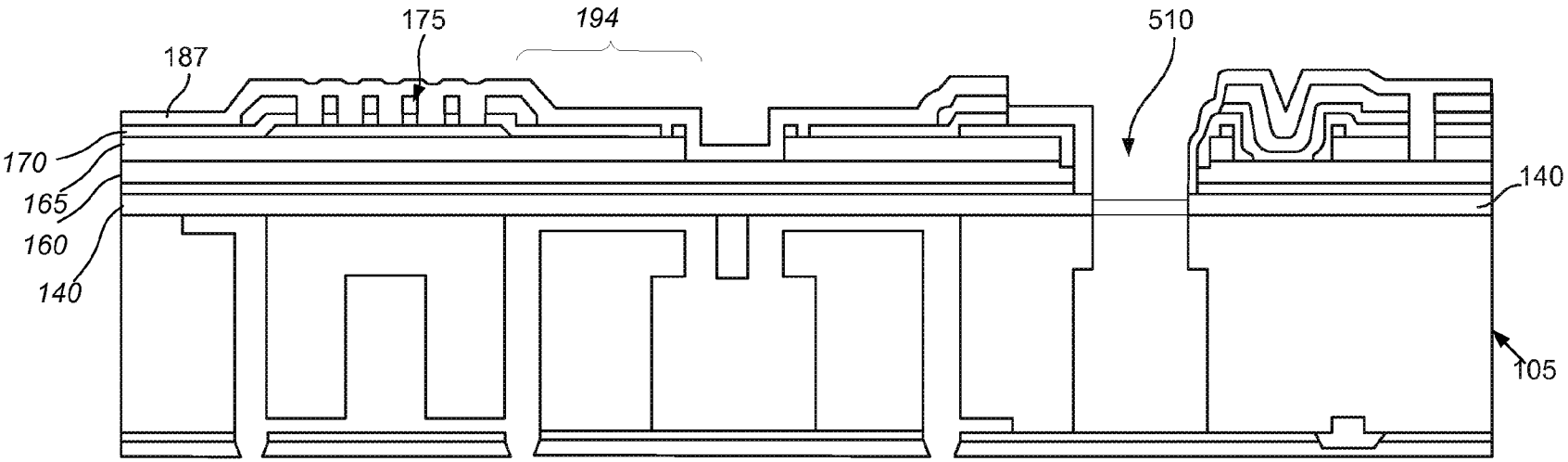
FIG. 5 is a cross-sectional view of a multi-layered actuator in a substrate, with a photoimageable material covering the substrate, including fill holes.

In some embodiments, as illustrated in FIG. 5, the photoimageable material 187, e.g., SU-8, is deposited on the entire surface of the substrate 105, including fill holes 510. Then the photoimageable material 187 is patterned using photolithography to open the fill holes 510 for fluid supply paths and expose electrical contacts for attaching a flexible circuit (not shown in FIG. 5). The photoimageable material 187, such as SU-8, deposited on the entire surface of the substrate 105 can protect the conductive layers 160 and 170, the conductive traces 175, or the piezoelectric layer 165 from being etched when the fill holes 510 are being etched open, especially the upper conductive layer 170 in the active region 194 that could easily be etched away because it can be as thin as about 2000 Å. The photoimageable material 187 can also protect the conductive layers 160 and 170, traces 175, and piezoelectric layer 165 during operation from environment or ink leaks that could cause damage, such as electrical shorts. In some embodiments, SU-8 is used because it is chemically inert and has a high selectivity to silicon. For example, when etching the fill holes 510, the silicon membrane 140 etches at a much faster rate than the SU-8.

Figure 6:
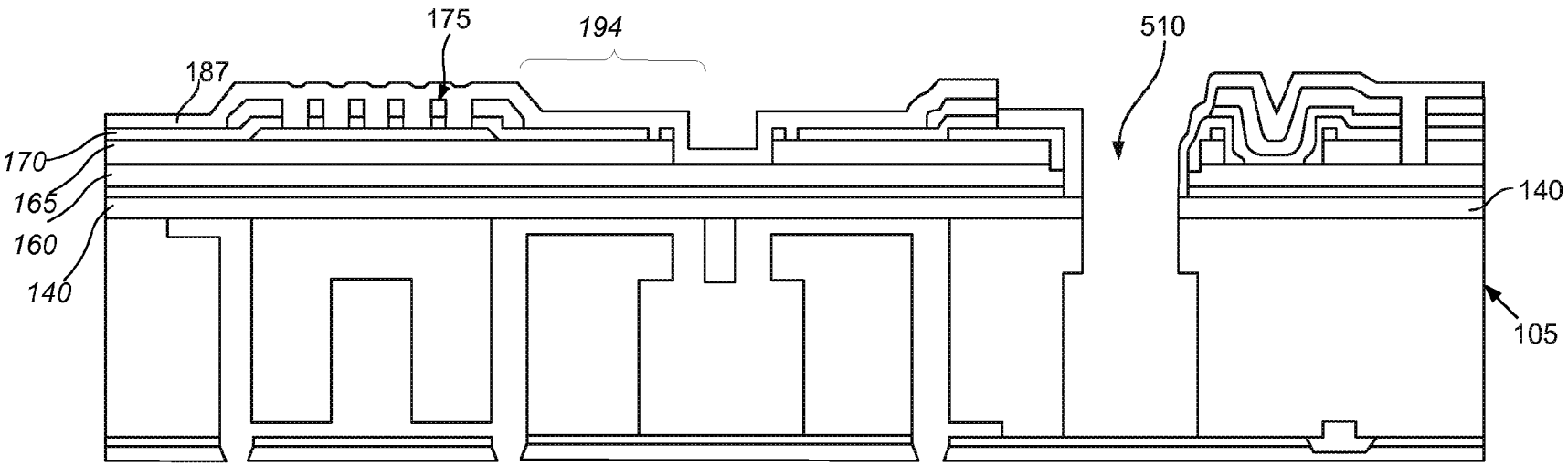
FIG. 6 is a cross-sectional view of a multi-layered actuator in a substrate, where a photoimageable material covering the substrate has been removed from fill holes.

In various embodiments, the photoimageable material 187 can be sprayed on the substrate 105 after step 400. The photoimageable material 187 is removed from top of electrodes to connect the flexible circuit and the fill holes 510. Then, as shown in FIG. 6, the fill holes 510 can be opened by etching, such as wet etching or dry etching (e.g., deep reactive-ion etching or DRIE).

The conductive traces are bonded to an interposer or substrate with the photoimageable material that covers on top of the traces (step 420). As with the bonding of the conductive traces, the bonding process for the interposer can include baking, exposing, and curing steps. Optionally, the steps involved in these two bonding processes can be implemented simultaneously.

It should be understood that various modifications can be made to the number of embodiments disclosed in this specification, without departing from the spirit or scope of the disclosure. For example, some embodiments can use only one conductive layer to receive signals. In another example, the actuator structure may be used in other MEMS devices such as transducers or sensors. However, the various modifications are still within the scope of this specification and the claims as follows.

The use of terminology such as "upper" and "lower," "bottom" and "top," "on," or "above" throughout the specification or claims serves for illustrative purposes only, to distinguish between various components of the printhead, actuator and other elements described herein. The use of these terms does not imply a particular orientation of the printhead or actuator. For example, the upper conductive layer described herein can be orientated to be the lower conductive layer in the actuator, and visa versa, depending on how the actuator is positioned.

What is claimed is:

1. A method for forming an actuator, comprising:

depositing a photoimageable material to form a first photoimageable layer on a first surface of a piezoelectric layer, the piezoelectric layer having a second surface in contact with a common electrode, the second surface being on a side of the piezoelectric layer opposite to the first surface and facing a first substrate containing pumping chambers, the common electrode having a surface area covering more than one of the pumping chambers;

patterning the first photoimageable layer to form a plurality of apertures exposing parts of the first surface of the piezoelectric layer;

disposing a first conductive layer on the first photoimageable layer, wherein the first conductive layer partially overlies the first photoimageable layer such that a first portion of the first conductive layer contacts the first photoimageable layer and a plurality of second portions of the first conductive layer electrically contact the piezoelectric layer in the plurality of apertures, and wherein each of the plurality of second portions of the first conductive layer each form a plurality of electrodes; and patterning the first portion of the first conductive layer to form a plurality of conductive traces on the first photoimageable layer, wherein each of the plurality of electrodes is electrically separated from the other of the plurality of electrodes, and each of the plurality of conductive traces is electrically separated from the other of the plurality of conductive traces and is connected to a corresponding one of the plurality of electrodes to individually control the corresponding one of the plurality of electrodes.

2. The method of claim 1, wherein the first photoimageable layer is an insulating layer between the first conductive layer and the piezoelectric layer.

3. The method of claim 1, wherein the photoimageable material includes SU-8.

4. The method of claim 1, further comprising:

depositing the photoimageable material in at least one space between adjacent two of the plurality of conductive traces disposed on the first photoimageable layer, wherein the photoimageable material between the adjacent two of the plurality of conductive traces contacts at least a portion of the first photoimageable layer.

5. The method of claim 1, further comprising depositing the photoimageable material to form a second photoimageable layer on the plurality of conductive traces formed from the first conductive layer.

6. The method of claim 1, further comprising:

disposing the piezoelectric layer adjacent to the first substrate, wherein each of the pumping chambers is formed adjacent to an upper surface of the first substrate and a nozzle, wherein each of the pumping chambers is in fluidic communication with the nozzle; and bonding the first substrate to a second substrate using the photoimageable material, wherein the piezoelectric layer is positioned between the first substrate and the second substrate.

7. The method of claim 6, further comprising coating at least one surface of the second substrate with the photoimageable material.

8. The method of claim 6, wherein disposing the piezoelectric layer includes disposing the piezoelectric layer on a membrane over the pumping chambers.

9. The method of claim 8, further comprising disposing the common electrode adjacent to the first substrate such that the piezoelectric layer is positioned between the first conductive layer and the common electrode.

10. The method of claim 1, wherein depositing the photoimageable material includes spraying the photoimageable material onto the piezoelectric layer and exposing the photoimageable material to ultraviolet light.

11. The method of claim 1, wherein depositing the photoimageable material includes spin coating the photoimageable material onto the piezoelectric layer and exposing the photoimageable material to ultraviolet light.

12. The method of claim 11, wherein depositing the photoimageable material onto the piezoelectric layer before the piezoelectric layer is patterned.

* * * * *